US009255754B1

(12) United States Patent
Kempf

(10) Patent No.: US 9,255,754 B1
(45) Date of Patent: Feb. 9, 2016

(54) CROSSBOW LOCK MECHANISM

(71) Applicant: James J. Kempf, Coralville, IA (US)

(72) Inventor: James J. Kempf, Coralville, IA (US)

( * ) Notice: Subject to any disclaimer, the term of this patent is extended or adjusted under 35 U.S.C. 154(b) by 213 days.

(21) Appl. No.: 14/146,177

(22) Filed: Jan. 2, 2014

(51) Int. Cl.
*F41B 5/12* (2006.01)

(52) U.S. Cl.
CPC ..... *F41B 5/12* (2013.01)

(58) Field of Classification Search
CPC ..... F41B 5/12; F41B 5/123; F41A 19/10; F41A 19/16
See application file for complete search history.

(56) References Cited

U.S. PATENT DOCUMENTS

| | | | | |
|---|---|---|---|---|
| 5,884,614 | A | 3/1999 | Darlington et al. | |
| 6,205,990 | B1 | 3/2001 | Adkins | |
| 6,736,123 | B1 | 5/2004 | Summers et al. | |
| 7,814,894 | B2 | 10/2010 | Giroux | |
| 8,091,540 | B2 * | 1/2012 | Matasic | F41B 5/12 124/25 |
| 2009/0194086 | A1 * | 8/2009 | Kempf | F41A 19/10 124/25 |
| 2014/0102431 | A1 * | 4/2014 | Kennedy | F41B 5/1469 124/35.1 |
| 2014/0182574 | A1 * | 7/2014 | Darlington | F41B 5/1403 124/35.1 |

* cited by examiner

*Primary Examiner* — Alvin Hunter
*Assistant Examiner* — Amir Klayman
(74) *Attorney, Agent, or Firm* — Donald J. Ersler

(57) ABSTRACT

An improved crossbow lock mechanism includes a trigger housing, a seer lever, a seer lock lever, a latch and a trigger. The seer lever includes an anti-dryfiring projection and a latch projection. The seer lever pivots relative to the trigger housing. The latch includes an arrow shaft yoke and a seer notch. The latch pivots relative to trigger housing. The seer notch engages the latch projection. The seer lock lever includes a latch finger and an impact finger. The latch finger is sized to capture the anti-dryfiring projection. A bow string is pulled back, until the seer notch of the latch is locked behind the latch projection. A nock of an arrow shaft is inserted over the bow string. The trigger lever is pulled, which causes the trigger linkage to push the latch projection downward and allow the latch to release the bow string.

12 Claims, 7 Drawing Sheets

CROSSBOW LOCK MECHANISM

BACKGROUND OF THE INVENTION

1. Field of the Invention

The present invention relates generally to archery and more specifically to an improved crossbow lock mechanism, which has fewer moving parts than that of the prior art.

2. Discussion of the Prior Art

U.S. Pat. No. 5,884,614 to Darlington et al. discloses a crossbow with improved trigger mechanism. U.S. Pat. No. 6,205,990 discloses a dry-fire prevention mechanism for crossbows. U.S. Pat. No. 6,736,123 to Summers et al. discloses a crossbow trigger. U.S. Pat. No. 7,814,984 to Giroux discloses a anti dry-fire device for crossbows.

Accordingly, there is a clearly felt need in the art for an improved crossbow lock mechanism, which prevents dry firing and has fewer moving parts than that of the prior art.

SUMMARY OF THE INVENTION

The present invention provides an improved crossbow lock mechanism, which prevents dry firing. A crossbow includes a riser, a barrel, two bow limbs, two cams, a bow string, a trigger housing and a stock. The two bow limbs extend from opposing sides of the riser at one end thereof. An opposing end of the riser extends from one end of the barrel and the stock extends from an opposing end of the barrel. Each bow limb is terminated with one of the two cams. The bow string is retained on the two cams. The trigger housing is contained within the stock.

The improved crossbow lock mechanism preferably includes the trigger housing, a seer lever, a seer lock lever, a latch and a trigger. The trigger housing includes a component half and a cover half. A mechanism cavity is formed in the component half to receive and retain the seer lever, the seer lock lever and the latch. The seer lever includes a seer base, an anti-dryfiring projection, a latch projection, and an elongated pivot link. The anti-dryfiring projection extends from one end of the seer base and the elongated pivot link extends from an opposing end of the seer base. The latch projection extends outward from a length of the seer base. One end of the elongated pivot link is pivotally retained in the component half. An opposing end of the elongated pivot link is pivotally retained by the trigger.

The trigger includes a trigger lever and a trigger link. An end of the trigger lever is pivotally retained on the barrel. One end of the trigger link is pivotally retained on the trigger lever, adjacent the trigger lever pivot point. The other end of the trigger link is pivotally retained on an opposing end of the pivot link. The latch includes a latch base, an arrow shaft yoke, a seer notch and a spring projection. The arrow shaft yoke extends from one side of the latch base and the spring projection extends from an opposing side of the latch base at one end thereof. The seer notch is formed in an opposing end of the latch base. The latch is pivotally retained in the mechanism cavity adjacent the spring projection. The seer notch engages the latch projection.

The seer lock lever includes a latch finger and an impact finger. The latch finger extends from one end of the seer lock lever and the impact finger extends from an opposing end of the seer lock lever. The latch finger is sized to capture the anti-dryfiring projection. A seer lever stop extends outward from the mechanism cavity in the component half, above the seer base and between the anti-dry firing projection and the latch projection to stop excessive upward motion of the seer lever. A latch ball stop is preferably retained between the impact finger and the seer lever stop, but may have other suitable locations.

In use, the bow string is pulled back, until the seer notch of the latch is locked behind the latch projection of the seer lever. A nock of an arrow shaft is moved over the bow string and placed in the arrow shaft yoke. The trigger lever is pulled, which causes the trigger linkage to push the seer lever downward. The latch projection moves downward and allows the opposing end of the latch base to pass by the latch projection and release the bow string from the cross bow. The latch ball stop provides a cushioned impact for latch.

Accordingly, it is an object of the present invention to provide an improved crossbow lock mechanism, which prevents dry firing and has fewer moving parts than that of the prior art.

These and additional objects, advantages, features and benefits of the present invention will become apparent from the following specification.

DETAILED DESCRIPTION OF THE PREFERRED EMBODIMENTS

Figure 1:
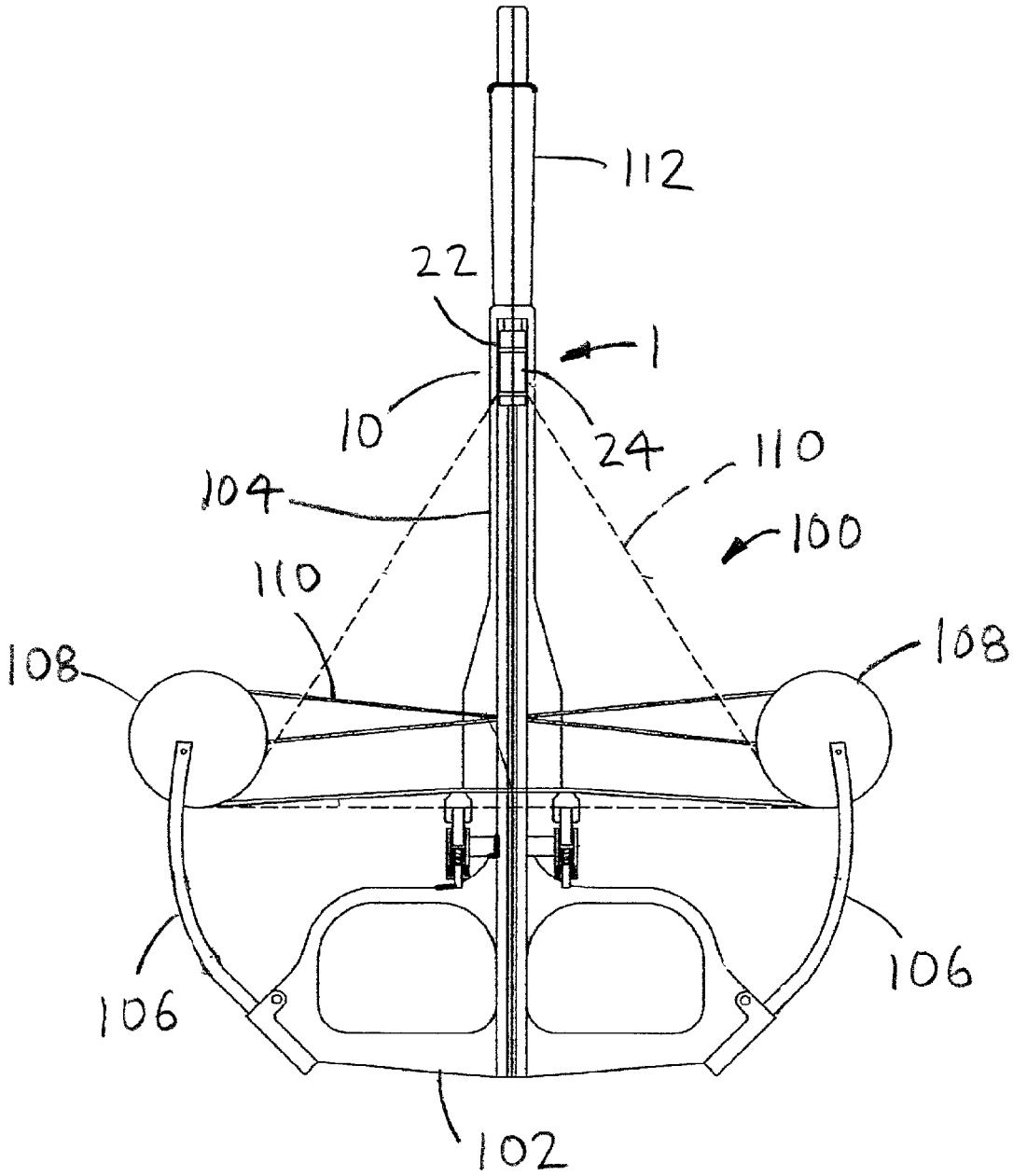
FIG. 1 is a top view of a crossbow of including an improved crossbow lock mechanism in accordance with the present invention.

With reference now to the drawings, and particularly to FIG. 1, there is shown a top view of a crossbow 100 of including an improved crossbow lock mechanism 1. The crossbow 100 includes a riser 102, a barrel 104, two bow limbs 106, two cams 108, a bow string 110, a stock 112 and a trigger housing 10. The two bow limbs 106 extend from opposing sides of the riser 102 at one end thereof. An opposing end of the riser 102 extends from one end of the barrel 104. The stock 112 extends from an opposing end of the barrel 104. Each bow limb 106 is terminated with one of the two cams 108. The bow string 110 is retained on the two cams 108. The trigger housing 10 is contained within the stock 112.

Figure 2:
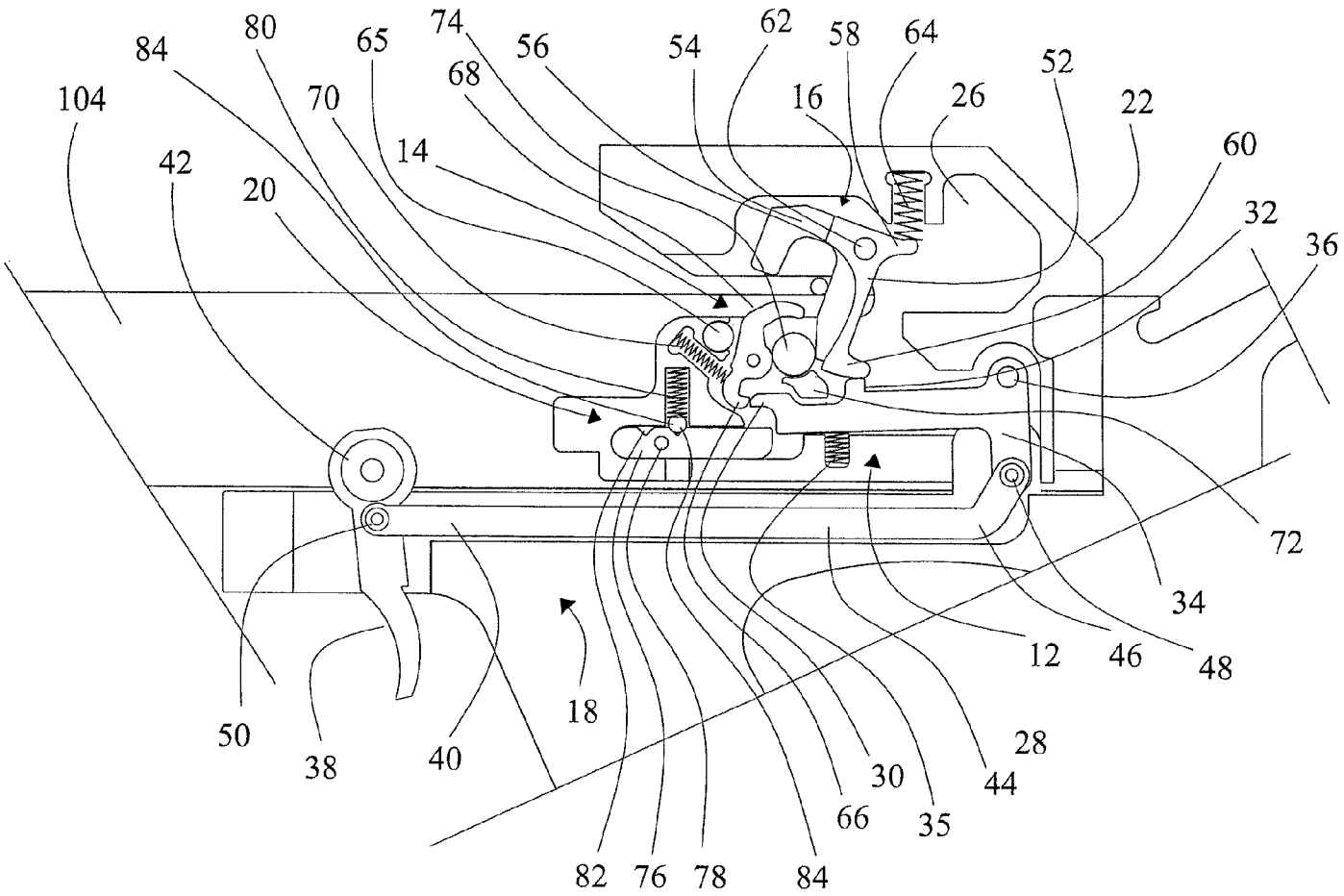
FIG. 2 is a side view of an improved crossbow lock mechanism with a cover half removed and illustrating a bow string pulled against a latch while cocking the latch in accordance with the present invention.
Figure 3:
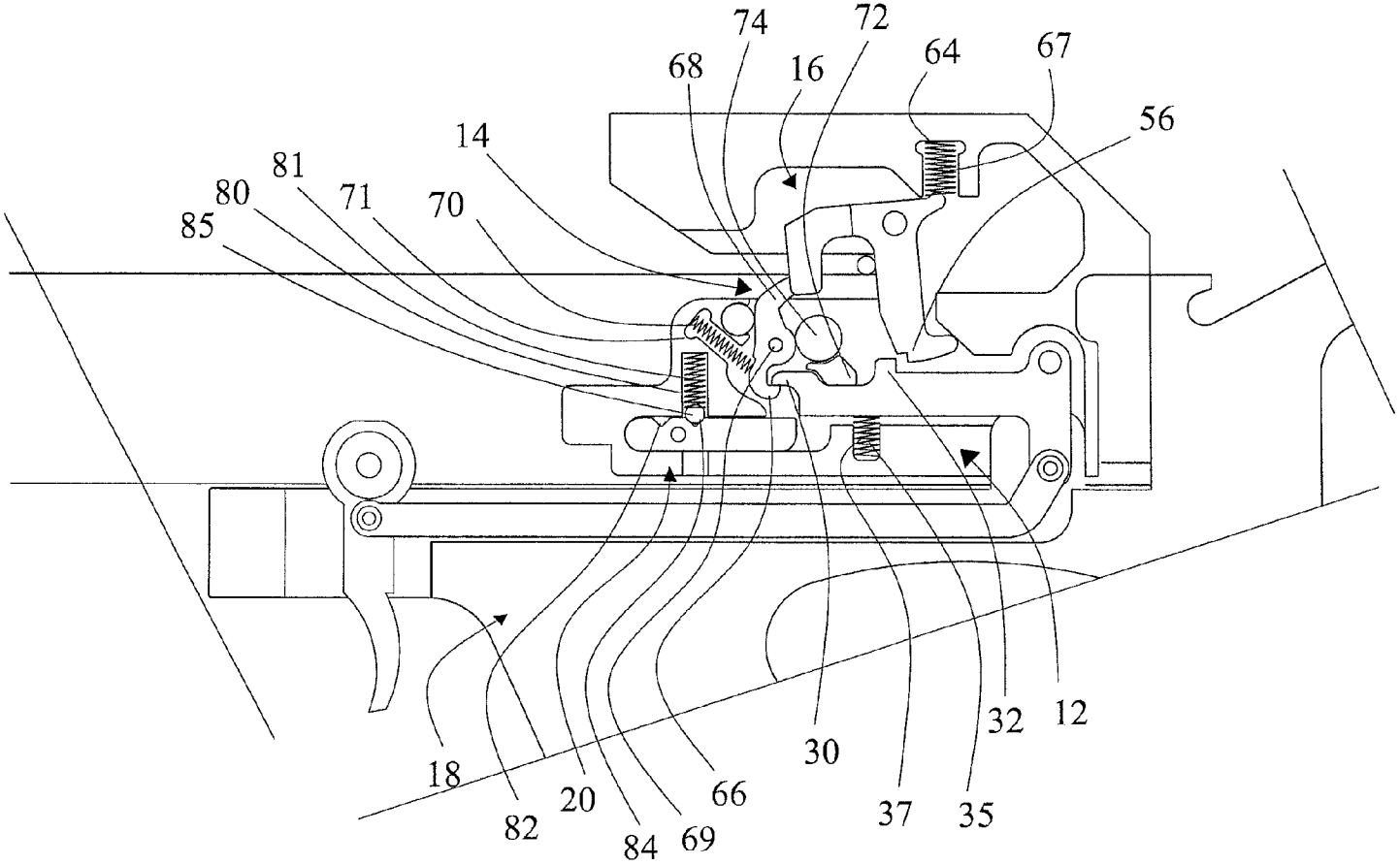
FIG. 3 is a side view of an improved crossbow lock mechanism with a cover half removed and illustrating a bow string pulled past a cocked position in accordance with the present invention.
Figure 4:
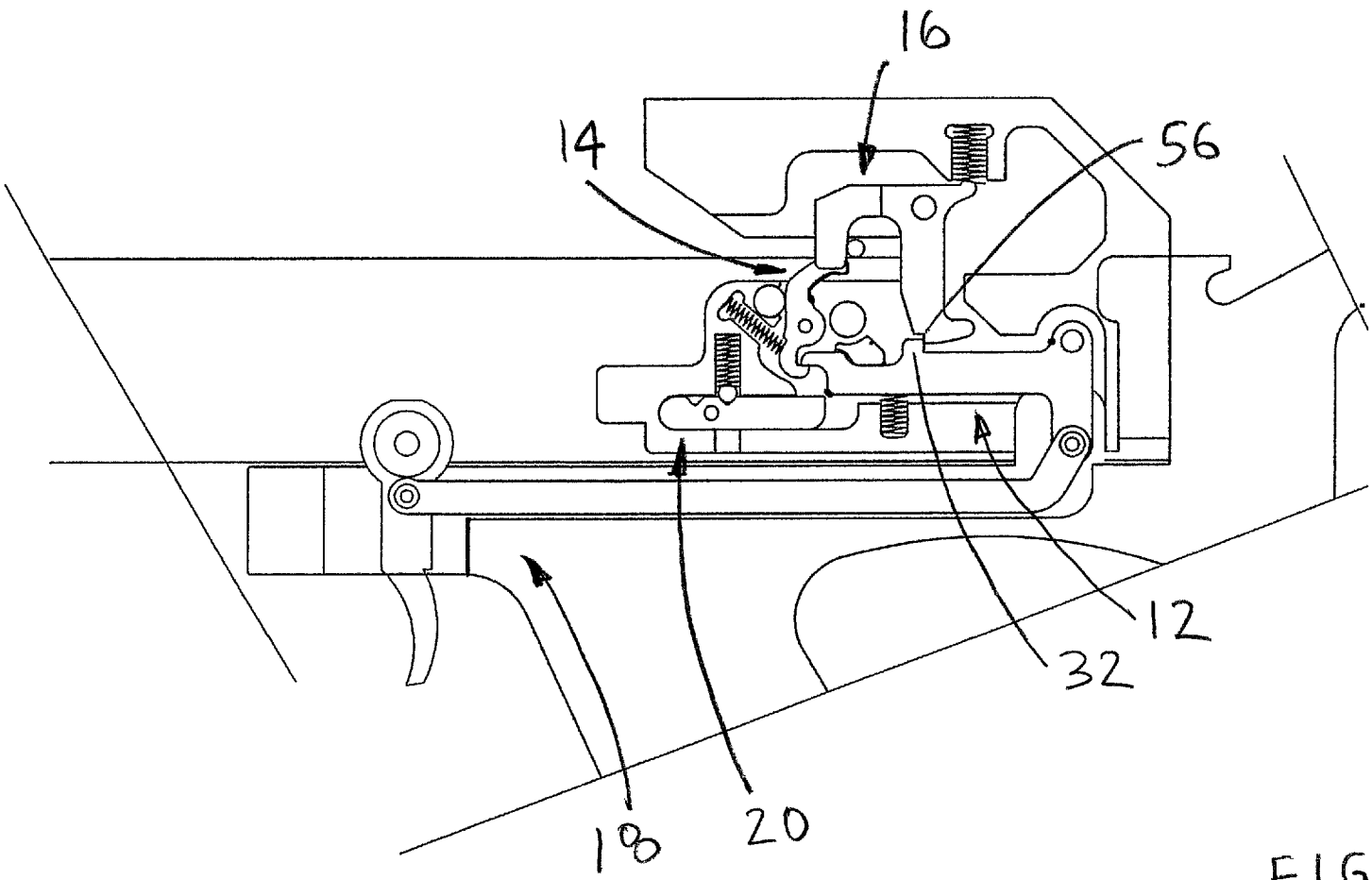
FIG. 4 is a side view of an improved crossbow lock mechanism with a cover half removed and illustrating a bow string in a cocked position with a safety in an off position in accordance with the present invention.

With reference to FIGS. 2-3, the improved crossbow lock mechanism 1 preferably includes the trigger housing 10, a seer lever 12, a seer lock lever 14, a latch 16, a trigger 18 and a safety 20. The trigger housing 10 includes a component half 22 and a cover half 24. A mechanism cavity 26 is formed in the component half 22 to receive and retain the seer lever 12, the seer lock lever 14, the latch 16 and the safety 20. The seer lever 12 includes a seer base 28, an anti-dryfiring projection 30, a latch projection 32, and an elongated pivot link 34. The anti-dryfiring projection 30 extends from one end of the seer base 28 and the elongated pivot link 34 extends from an opposing end of the seer base 28, substantially perpendicular to the seer base 28. The latch projection 32 extends outward from a length of the seer base 28. One end of the pivot link 34 is pivotally retained in the component half 22 with a seer pivot pin 36. A seer compression spring 35 is retained in a seer spring cavity 37. The seer compression spring 35 biases the seer lever 12 toward the latch 16. The trigger 18 includes a trigger lever 38 and a trigger link 40. An end of the trigger lever 38 is pivotally retained on the barrel 104 with a fastener 42 or the like. The trigger link 40 includes an elongated body 44 and an end leg 46. The end leg 46 preferably extends outward from one end of the elongated body 44 at an obtuse angle. An opposing end of the elongated pivot link 34 is pivotally retained by an end of the end leg 46 with a pivot pin 48. An opposing end of the trigger link 44 is pivotally retained on the trigger lever 38, adjacent the fastener 42 with a pivot pin 50.

The latch 16 includes a latch base 52, an arrow shaft yoke 54, a seer notch 56, a spring projection 58 and a latch foot 60. The arrow shaft yoke 54 extends from one side of the latch base 52 and the spring projection 58 extends from an opposing side of the latch base 52 at one end thereof. The seer notch 56 is formed on the one side of the latch base 52 and the latch foot 60 is formed on the opposing side of the latch base 52 at an opposing end thereof. The one end of the latch base 52 is pivotally retained in the mechanism cavity 26 with a pivot pin 62, adjacent the spring projection 58. A latch spring 64 is retained in a latch spring cavity 67. The latch spring 64 contacts the spring projection 58 and biases the latch foot 60 to contact the latch projection 32. With reference to FIGS. 3-6, the seer notch 56 engages the latch projection 32 to place the improved crossbow lock mechanism 1 is in a cocked position.

The seer lock lever 14 includes a latch finger 66 and an impact finger 68. The seer lock lever 14 is retained in the mechanism cavity 26 with a pivot pin 69. The latch finger 66 extends from one end of the seer lock lever 14 and the impact finger 68 extends from an opposing end of the seer lock lever 14. A seer lock lever ball stop 65 is preferably located behind the impact finger 68, but may have other suitable locations. The seer lock lever ball stop 65 is preferably fabricated from a rubber material, but other resilient materials may also be used. The seer lock lever ball stop 65 provides an impact cushion for the impact finger 68.

With reference to FIG. 3, the latch finger 66 is sized to capture the anti-dryfiring projection 30. A lock spring 70 is retained in a lock spring cavity 71. A lock spring 70 biases the latch finger 66 toward the anti-dryfiring projection 30. A seer lever stop 72 extends outward from the mechanism cavity 26 in the component half 22, above the seer base 28 and between the anti-dry firing projection 30 and the latch projection 32 to stop excessive upward motion of the seer lever 12. A latch ball stop 74 is preferably retained between the seer lock lever 14 and the seer lever stop 72, but may have other suitable locations. The latch ball stop 74 is preferably fabricated from a rubber material, but other resilient materials may also be used. The latch ball stop 74 provides an impact cushion for the seer lock lever 14 and the latch 16.

Figure 5:
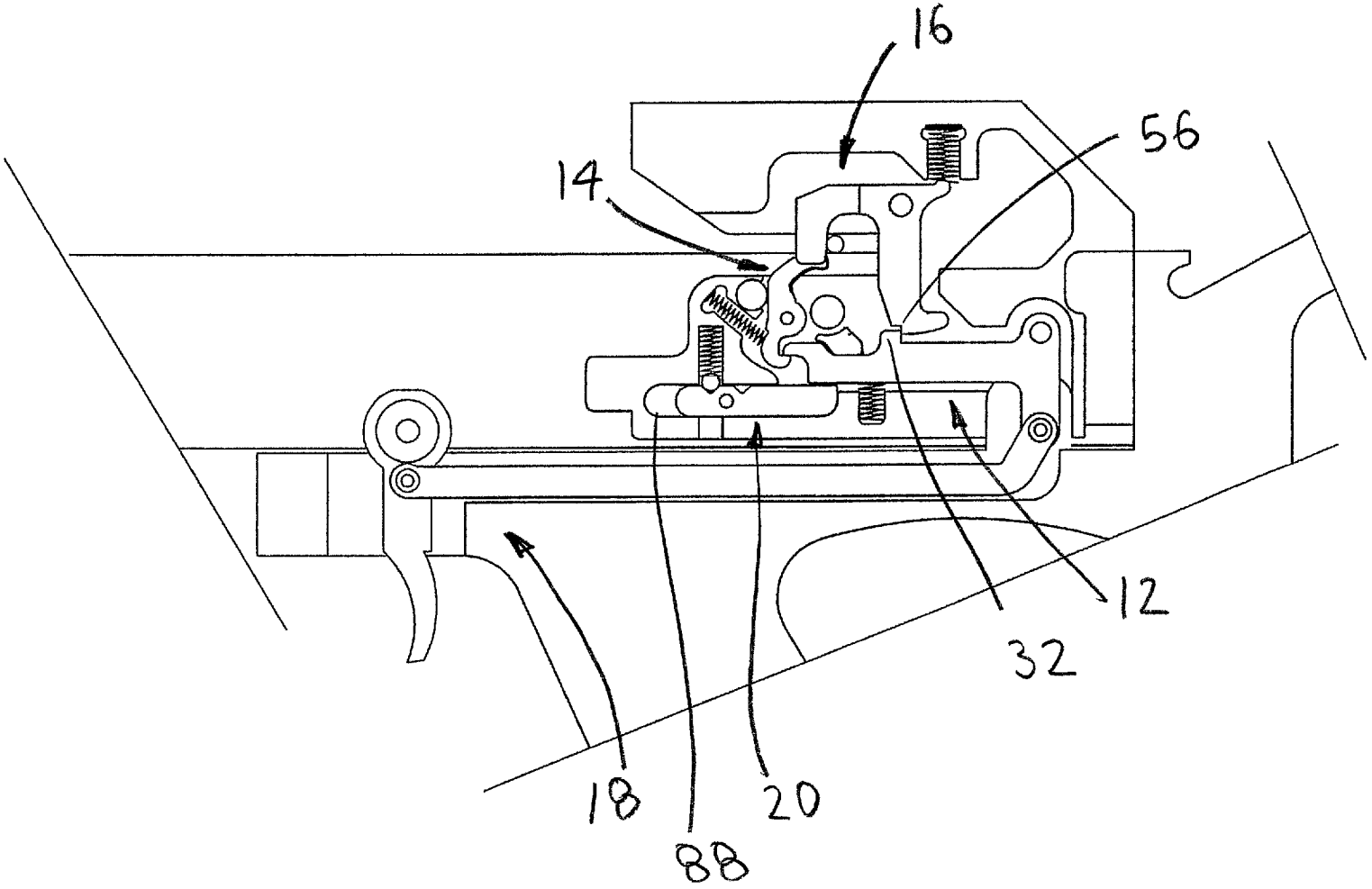
FIG. 5 is a side view of an improved crossbow lock mechanism with a cover half removed and illustrating a bow string in a cocked position with a safety in an on position in accordance with the present invention.

The safety 20 includes a lock bar 76, a slide pin 78 and a position lock spring 80. A lock notch 82 and a fire notch 84 are formed in a top of the lock bar 76. A notch ball 85 engages the lock and fire notches 82, 84 and is biased toward the lock bar 76 with the position lock spring 80. The position lock spring 80 is retained in a position lock cavity 81. The slide pin 78 is pressed through the lock bar 76. With reference to FIG. 5, a slot 86 is formed through the component half 22 and the cover half 24 (not shown) to provide clearance for the slide pin 78 and allow the safety 30 to be shuttled between a locked position and a fire position. The lock bar 76 is maintained in position by the position lock spring 80 forcing the notch ball 85 into the lock notch 82 or the fire notch 84. With reference to FIG. 5, the lock bar 76 is retained in a safety cavity 88 formed in the component half 22.

Figure 6:
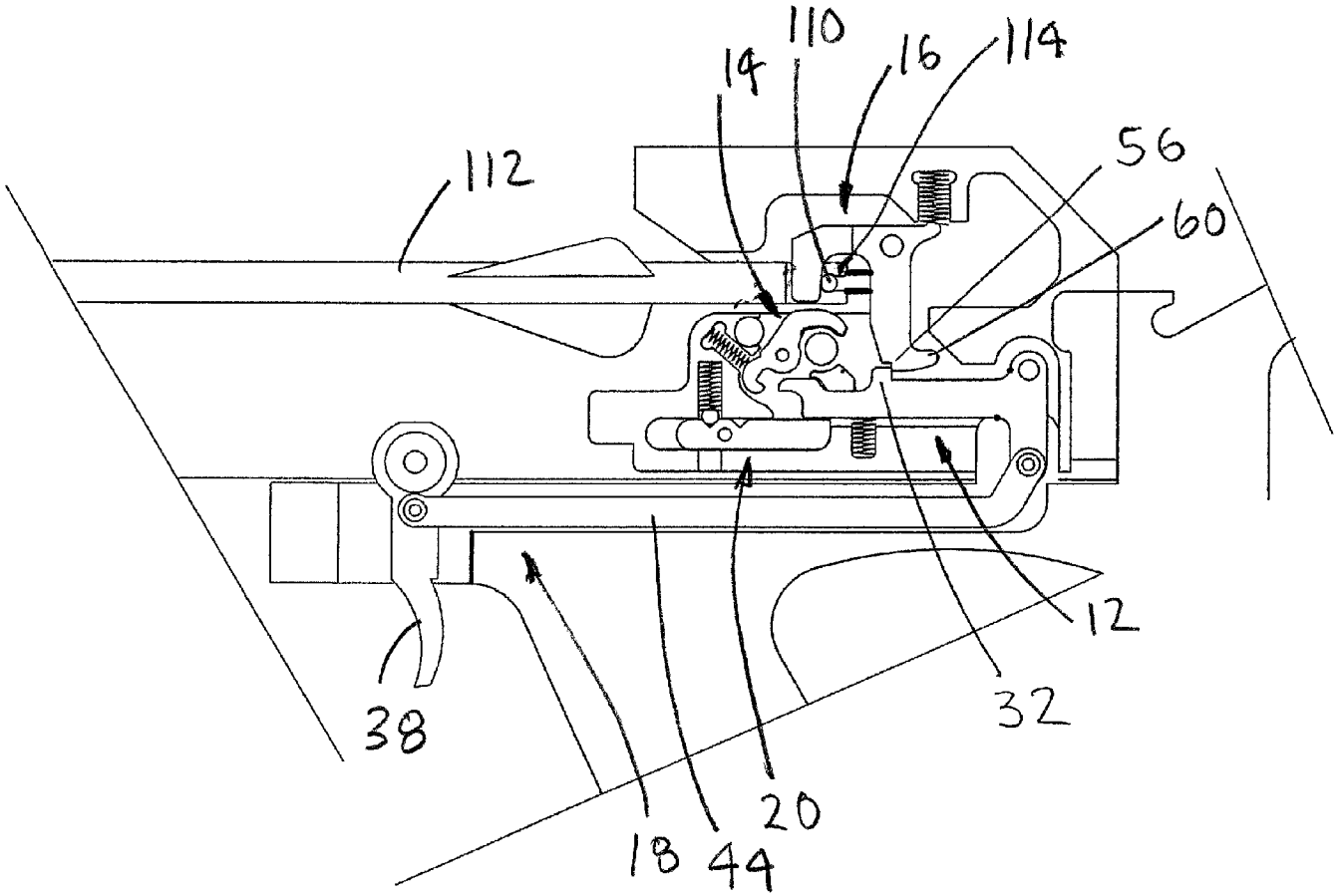
FIG. 6 is a side view of an improved crossbow lock mechanism with a cover half removed and illustrating a bow string in a cocked position with a safety in an on position with an arrow ready to be fired in accordance with the present invention.
Figure 7:
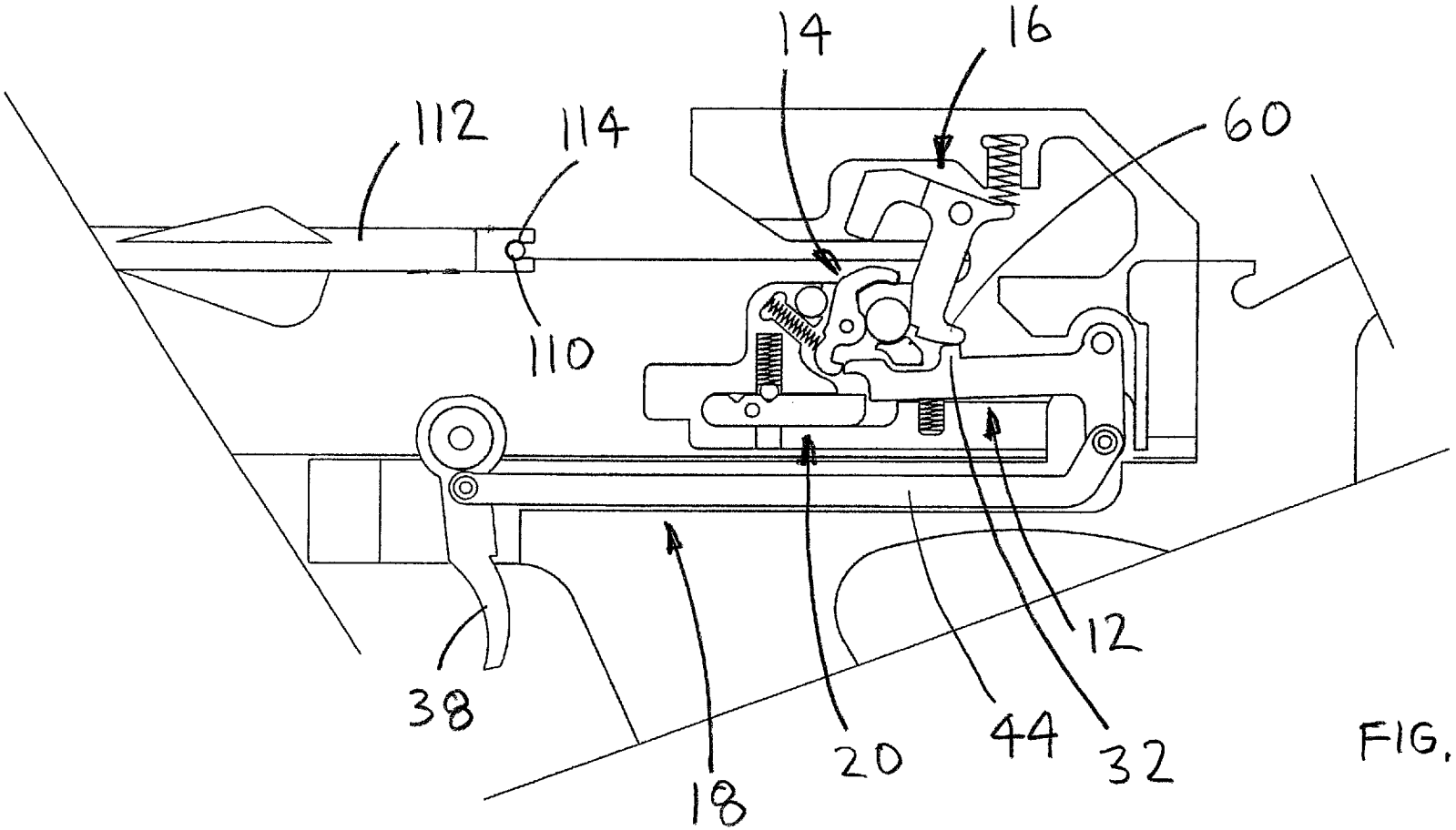
FIG. 7 is a side view of an improved crossbow lock mechanism with a cover half removed and illustrating an arrow just fired in accordance with the present invention.

With reference to FIGS. 6-7, the improved crossbow lock mechanism 1 works in the following manner. The bow string 110 is pulled back, until the seer notch 56 of the latch 16 is locked behind the latch projection 32 of the seer lever 12. A nock 114 of an arrow shaft 112 is inserted over the bow string 110. The trigger lever 38 is pulled, which causes the trigger linkage 44 to push the seer lever downward 12. The latch projection 32 moves downward and allows the opposing end of the latch foot 60 to pass by the latch projection 32 and release the bow string 110 from the cross bow 100.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An improved crossbow lock mechanism comprising:

a trigger housing;

a safety bar having an on position and an off position;

a seer lever includes a latch projection and an anti-dryfiring projection, said anti-dryfiring projection extends from an end of said seer lever, said seer lever pivots relative to said trigger housing;

a seer lock lever includes a latch finger, said latch finger captures said anti-dryfiring projection, said seer lock lever pivots relative to said trigger housing independently of said seer lever;

a latch includes a latch base, a latch foot, a seer notch and an arrow shaft yoke, said seer notch is formed on one side of said latch base, said latch foot extends from an opposing side of said latch base, said latch pivots relative to said trigger housing, said arrow shaft yoke is sized to receive a nock of an arrow shaft, wherein said latch projection is positioned to engage said seer notch when said improved crossbow lock mechanism is cocked, said arrow shaft yoke retains a bow string in a cocked position, said latch foot forces an end of said seer lever downward when a bottom of said latch foot contacts a top of said latch projection which prevents said safety bar from being placed in said on position; and a trigger pivots relative to said trigger housing, said trigger is linked to said seer lever, wherein actuating said trigger causes said latch projection to release said latch, and the bow string.

2. The improved crossbow lock mechanism of claim 1, further comprising:

a safety includes a lock bar and a slide pin, said slide pin is retained in said lock bar, said slide pin used to prevent said latch from releasing a bow string.

3. The improved crossbow lock mechanism of claim 1 wherein:

said trigger includes a trigger lever and a trigger linkage, said trigger lever is pivotally retained relative to said trigger housing, one end of said trigger linkage is pivotally retained by said trigger lever, the other end of said trigger linkage is pivotally connected to said seer lever.

4. The improved crossbow lock mechanism of claim 1, further comprising:

a seer lever stop is positioned above said seer lever.

5. The improved crossbow lock mechanism of claim 4, further comprising:

a latch ball stop is fabricated from a resilient material, said latch ball stop provides a cushion for said latch.

6. The improved crossbow lock mechanism of claim 1 wherein:

said trigger housing includes a component half and a cover half, a mechanism cavity is formed in said component half to retain at least said seer lever and said latch.

7. An improved crossbow lock mechanism comprising:

a trigger housing;

a safety bar having an on position and an off position;

a seer lever includes a latch projection and anti-dryfiring projection, said latch projection extends from a top of said seer lever, said anti-dryfiring projection extends from an end of said seer lever, said seer lever pivots relative to said trigger housing;

a seer lock lever includes a latch finger, said latch finger captures said anti-dryfiring projection, said seer lock lever pivots relative to said trigger housing independently of said seer lever;

a latch includes a latch base, a latch foot, a seer notch and an arrow shaft yoke, said seer notch is formed on one side of said latch base, said latch foot extends from an opposing side of said latch base, said latch pivots relative to said trigger housing, said seer lever is biased toward said latch, said arrow shaft yoke is sized to receive a nock of an arrow shaft, said latch is biased to release a bow string, wherein said latch projection is positioned to engage said seer notch when said improved crossbow lock mechanism is cocked, said latch retains a bow string in a cocked position, said latch foot forces an end of said seer lever downward when a bottom of said latch foot contacts a top of said latch projection which prevents said safety bar from being placed in said on position; and a trigger pivots relative to said trigger housing, said trigger is linked to said seer lever, wherein actuating said trigger causes said latch projection to release said latch, and the bow string.

8. The improved crossbow lock mechanism of claim 7, further comprising:

a safety includes a lock bar and a slide pin, said slide pin is retained in said lock bar, said slide pin used to prevent said latch from releasing a bow string.

9. The improved crossbow lock mechanism of claim 7 wherein:

said trigger includes a trigger lever and a trigger linkage, said trigger lever is pivotally retained relative to said trigger housing, one end of said trigger linkage is pivotally retained by said trigger lever, the other end of said trigger linkage is pivotally connected to said seer lever.

10. The improved crossbow lock mechanism of claim 7, further comprising:

a seer lever stop is positioned above said seer lever.

11. The improved crossbow lock mechanism of claim 10, further comprising:

a latch ball stop is fabricated from a resilient material, said latch ball stop provides a cushion for said latch.

12. The improved crossbow lock mechanism of claim 7 wherein:

said trigger housing includes a component half and a cover half, a mechanism cavity is formed in said component half to retain at least said seer lever and said latch.

* * * * *